United States Patent [19]

Lyons et al.

[11] 4,160,338

[45] Jul. 10, 1979

[54] SOUND EMITTING AND WETTING DOLL

[75] Inventors: Paul Lyons, Darenth, England; Fred Zant, Boonton, N.J.; Charles Resnick, Great Neck, N.Y.

[73] Assignee: Ned Strongin Associates, Inc., New York, N.Y.

[21] Appl. No.: 857,253

[22] Filed: Dec. 5, 1977

[30] Foreign Application Priority Data

Dec. 29, 1976 [GB] United Kingdom ..... 54203/76

[51] Int. Cl.[2] ..... A63H 29/16

[52] U.S. Cl. ..... 46/44; 46/117; 46/141

[58] Field of Search ..... 46/44, 117, 118, 141

[56] References Cited

U.S. PATENT DOCUMENTS

| | | | |
|---|---|---|---|
| 1,163,368 | 12/1915 | Rosofsky | 46/117 |
| 2,606,399 | 8/1952 | Graham | 46/117 X |
| 2,653,411 | 9/1953 | Beltz | 46/117 |
| 2,907,139 | 10/1959 | Rekettye | 46/141 X |
| 3,916,561 | 11/1975 | Kato | 46/118 |
| 3,996,695 | 12/1976 | Sapkus et al. | 46/44 X |

FOREIGN PATENT DOCUMENTS

| | | | |
|---|---|---|---|
| 301135 | 9/1932 | Italy | 46/117 |

*Primary Examiner*—Russell R. Kinsey
*Assistant Examiner*—Mickey Yu
*Attorney, Agent, or Firm*—Edward F. Levy

[57] ABSTRACT

A toy doll has a mouth opening adapted to receive a simulated nursing bottle from which water is fed to the interior of the doll, some of such water producing a wetting action. The doll is also adapted to produce a burping sound when its back is patted, and simultaneously to spit up through the mouth opening some of the water previously fed from the bottle. The burping sound is produced by a bellows in the body portion of the doll which is successively compressed upon patting the back of the doll and which progressively feeds air into another bellows located in the head of the doll until the head bellows reaches an expanded position. An actuating member then automatically releases the air from the expanded head bellows, which air flows in a sudden controlled flow through a sound producing device. Some of this released air also causes liquid to be emitted from the mouth opening to produce the spitting-up effect.

10 Claims, 6 Drawing Figures

SOUND EMITTING AND WETTING DOLL

The present invention relates to improvements in dolls and is particularly concerned with dolls which are intended to simulate the bottle feeding of babies. An object of the invention is to provide a doll adapted to be handled in a natural manner by a child, with the doll imitating many of the actions of a real baby both during and after bottle feeding.

According to one aspect of the invention, there is provided a doll comprising mouth means and wetting means for co-operation with a simulated feeding bottle, and also comprising pneumatically operated sound producing means co-operating with an air supply means arranged to function in response to a patting action against a displaceable portion of the doll.

It is known to provide dolls which produce sounds, including "burping" sounds when a portion of the doll is squeezed or depressed. Normally, however, the burping sound produced has little or no relationship to the feeding of the doll, or to the natural motion of patting or rubbing the back of the doll in successive steps until the sound is produced.

Another object of the invention is to provide a doll containing cooperating bellows mechanisms in the head and body thereof for producing a delayed-action burping sound in response to successive patting of the back portion of the doll body. The mechanism is adapted to produce a sudden but controlled flow of air through a de-tuned reed sound producing means, so as to produce a realistic burping sound.

A further object ofthe invention is the provision of a doll of the character described which is capable of being bottle-fed to produce a "wetting" action. In addition, the doll is provided with a mouthpiece containing a water reservoir which cooperates with the bellows mechanism to produce a "spitting-up" effect simultaneously with the burping sound produced.

In accordance with the invention, there is provided a doll having a hollow head and a hollow body communicating with said head and having a flexible wall. A body bellows is mounted within said doll body and is operatively associated with said flexible wall for compression when said flexible wall is depressed inwardly. The body bellows has an outlet and a one-way outlet valve connected to said outlet. The doll also includes a head bellows mounted within the interior of the doll head and having an inlet port, on outlet port, an outlet valve normally closing said outlet port, and biasing means urging said head bellows to a compressed position. Pneumatically-operated sound producing means is mounted within the doll head and communicates with the outlet port of said head bellows.

Conduit means connects the body bellows outlet to the inlet port of the head bellows for supplying a charge of air to the interior of said head bellows with each compression of said body bellows, the head bellows being adapted to expand in successive increments from said compressed position to an expanded release position upon successive compression of said body bellows. Valve release means is also mounted within said head bellows and is operatively connected to a moveable portion of the head bellows and operatively associated with the outlet valve of said head bellows for opening said outlet valve in response to expansion of said head bellows to said release position. The opening of said outlet valve permits the biasing means to move the head bellows to its compressed position, thereby causing air in said head bellows to escape in a sudden flow through said outlet port and through said sound producing means to produce a burping sound.

In a preferred embodiment, the outlet valve of the head bellows includes a flexible valve disc sealingly overlying the outlet port of the head bellows, and the valve release means comprises a lever pivotally mounted within the head bellows, with one arm thereof connected to the moveable end wall of the head bellows and the other arm thereof engaging the portion of the valve disc which overlies the outlet port.

The doll also includes a mouthpiece communicating with the mouth of the doll head and having a reservoir adapted to receive and store water fed through the mouth. The mouthpiece also has an air chamber located adjacent the reservoir and separated therefrom by a flexible diaphragm. The air chamber communicates with the outlet port of the head bellows for receiving a flow of air therefrom when the valve release means is operated. This flow of air causes the diaphragm to force water out of said reservoir through the doll mouth to provide a spitting effect when the doll produces a burping sound.

Additional objects and advantages of the invention will become apparent during the course of the following specification when taken in connection with the accompanying drawings, in which.

Figure 1:
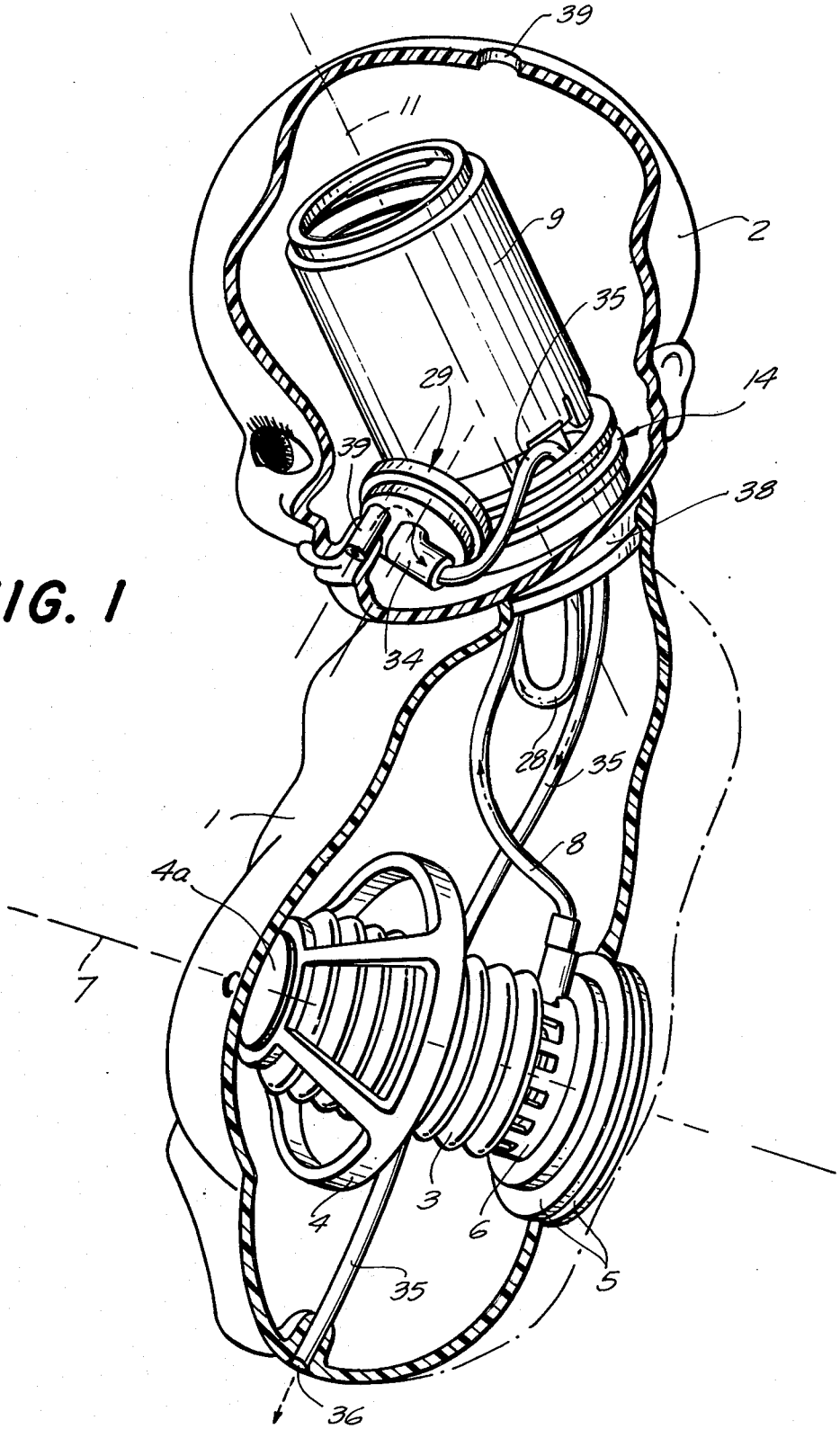
FIG. 1 is a perspective view of the head and body of a doll made in accordance with the present invention, with portions thereof cut away to disclose the mechanism therewithin.

Referring in detail to the drawings, there is shown the head and torso portion of a doll which simulates a baby that can be bottle fed, the arms and legs being omitted in the drawings, since they form no part of the invention. The doll has a flexible hollow body, designated generally by reference numeral 1, which is formed from a resiliently deformable material which will rapidly revert to its original configuration after being deformed, for example by squeezing or patting. The body 1 may be formed of plasticized polyvinyl chloride which possesses the aforementioned properties and is conventionally used for bodies, heads and limbs of dolls. The doll also includes a hollow head 2 which is initially separate, and which is also preferably made of polyvinyl chloride. The baby doll which is illustrated by way of example in the accompanying drawings can be fed with a simulated bottle, will "wet" a diaper or other garment (if provided), will burp when its back is patted, and, if water from the simulated feeding bottle is still present, will dribble at the same time that it produces a burp. The means by which these various functions are accomplished will now be described in detail.

Figure 2:
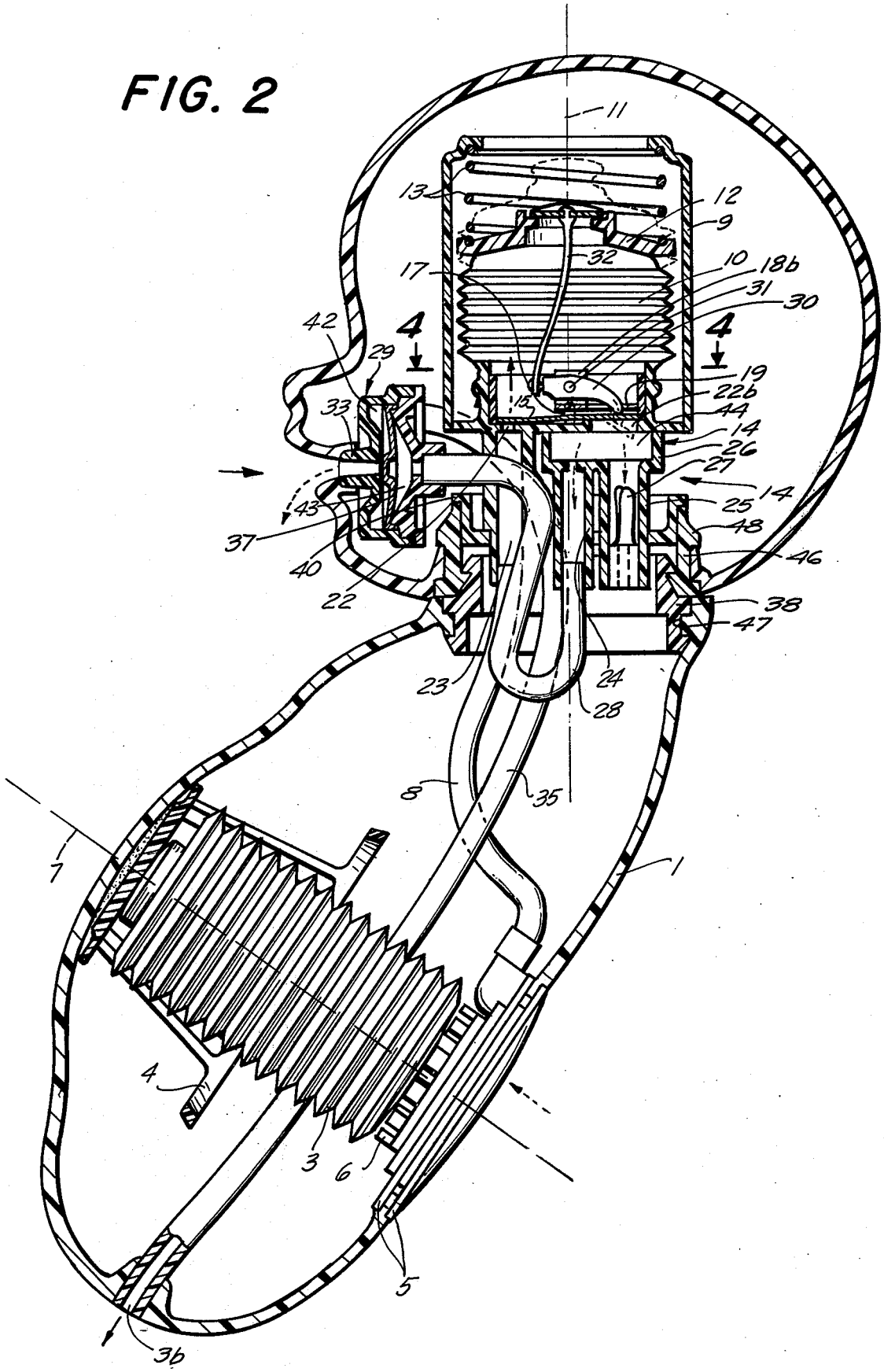
FIG. 2 is a longitudinal central section through the doll shown in FIG. 1.

A bellows 3 is mounted internally of the body 1 with its forward end portion secured within and protected by a bellows cage 4 which is of skeletal frustoconical configuration (FIG. 1). The apex end 4*a* of the cage 4 is fixedly cemented to the inner surface of the body 1 substantially in register with the simulated abdomen of the baby doll. The bellows 3 extends transversely between the front and rear walls of the body 1, with one end of the body bellows 3 being secured to the cage 4 at the apex end 4*a* of the latter while the opposite end thereof is located quite close to that region of the body 1 which simulates the small of the back of the baby doll. As shown in FIGS. 1 and 2, the aforementioned small of the back region of the body 1 is formed with an aperture within which is mounted a mounting plate 5, the inner and outer peripheral flange portions of which are sealed to the edges of said aperture. The mounting plate 5 carries a combined air inlet and one-way valve 6 to which the other end of the body bellows 3 is attached. It will be seen from FIGS. 1 and 2 that an axis 7 along which the body bellows 3 is compressible and expandible, extends between the abdomen and the small of the back of the body 1 and the intention is that, in the use of the doll, the baby's back should be patted in the region of the mounting plate 5 so that the body bellows 3 will be repeatedly compressed and expanded, the back of the body 1 being flexibly displaceable, as discussed above, to allow for changes in the configuration of the bellows 3.

The one-way valve portion of the combined air inlet and one-way valve 6 is connected by a flexible synthetic plastic tube 8 to a cylindrical housing 9 which is mounted inside the head 2 of the doll and which contains a head bellows 10. The housing 9 guidingly surrounds the head bellows 10 so that the latter will be able to compress and expand along an axis 11 which substantially coincides with the longitudinal axis of the cylindrical housing 9 itself. The end of the head bellows 10 which is remote from the doll body 1 carries a domed and movable abutment plate 12 and a light helical compression spring 13 bears between a rim of the abutment plate 12 and an internal rim at the upper (when the doll is upright) end of the open-topped housing 9. It will be appreciated that the spring 13 tends to move the abutment plate 12 downwardly towards the body 1 and thus to maintain the head bellows 10 in the compressed position shown in FIG. 1. The end of the head bellows 10 which is closest to the doll body 1 terminates in an open mouth which is sealingly connected to a cylindrical mounting portion of a valve assembly which is generally designated by reference numeral 14.

Figure 3:
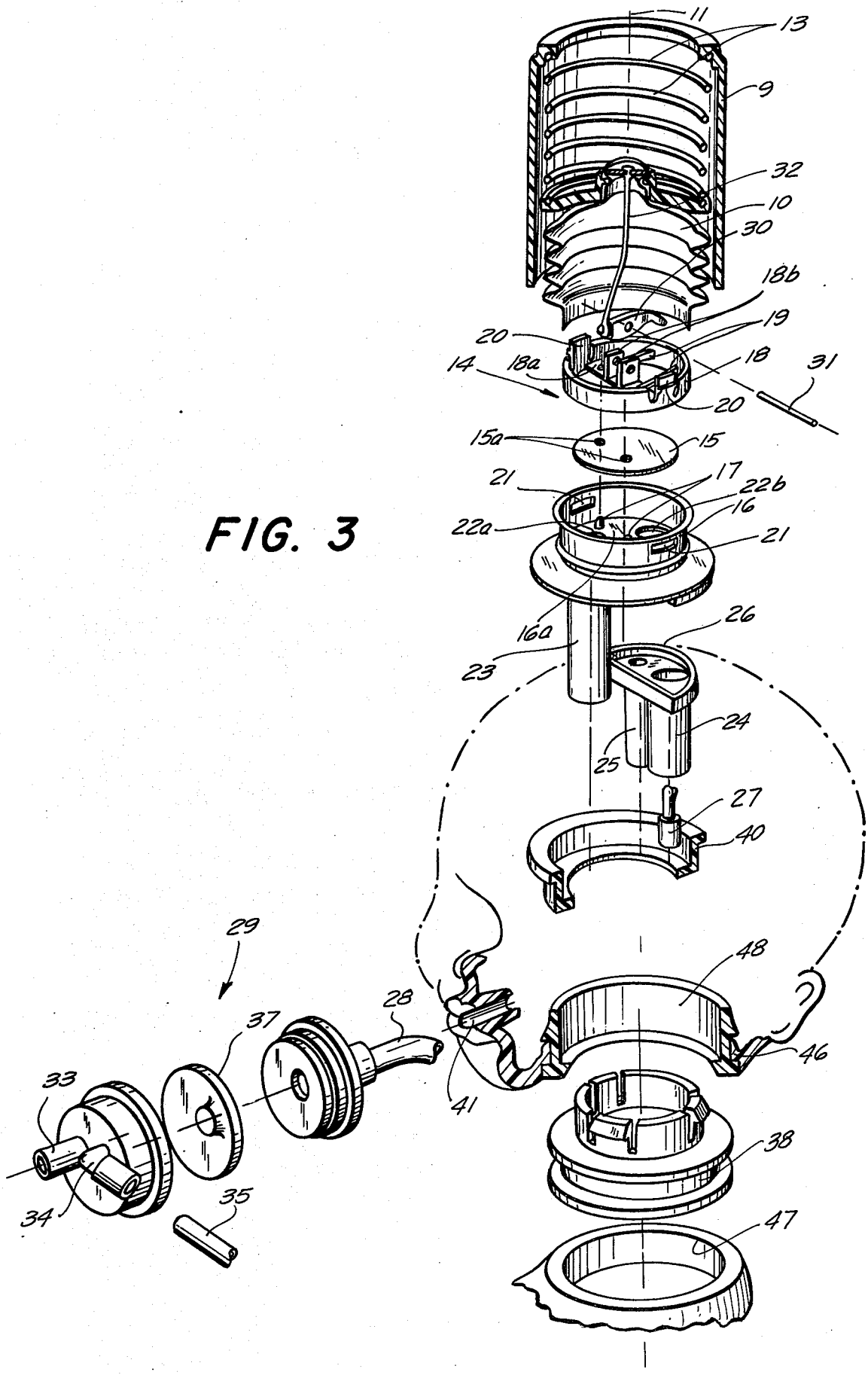
FIG. 3 is an exploded view of the parts contained within the head and neck portions of the doll, with portions of some parts being broken away and shown in section.
Figure 4:
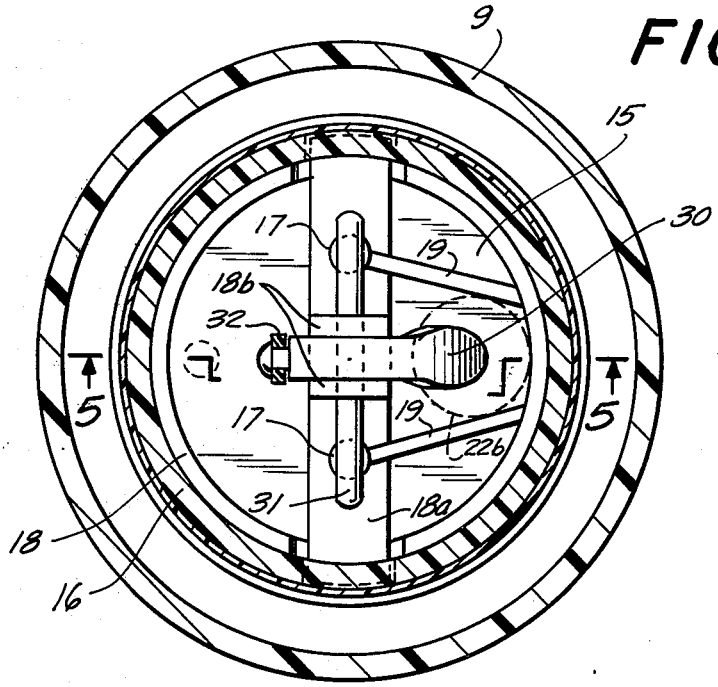
FIG. 4 is an enlarged section taken along line 4—4 of FIG. 2.

The valve assembly 14, as best seen in FIG. 3, includes a flexible valve disc 15 which serves a dual purpose as will be presently explained, a ported cylindrical carrier 16 which supports the valve disc 15 by way of a pair of pins 17 upstanding from the bottom wall 16*a* thereof and snugly fitting into corresponding apertures 15*a* in the disc 15, and an overlying annular guide 18 formed with a cross-bar 18*a*. A pair of spaced ribs 19 extend from the cross-bar 18*a* to the inner circumference of the annular guide 18 and are arranged to overlie and prevent excessive flexible displacement of the valve disc 15. It will be seen in FIG. 3 that when the valve assembly 14 is connected together, the annular guide 18 fits within the top open end of the cylindrical carrier 16 and hook-like projections 20 carried by guide 18 snap into respective openings 21 in the cylindrical wall of the carrier 16 to lock the annular guide 18 in mounted position with the flexible valve disc 15 being trapped on the pins 17 between at least the ribs 19 of the guide 18 and the ported bottom wall 16*a* of the carrier 16 upon which pins 17 are mounted.

When the valve assembly 14 is connected together, the left-hand side thereof, as viewed in FIG. 3, co-operates with an inlet port 22*a* in the bottom wall 16*a* of carrier 16, and the right-hand side thereof co-operates with an outlet port 22*b*. In its mounted position, the flexible valve disc 15 rests flush upon the bottom wall 16*a* of carrier 16, and covers over both inlet port 22*a* and outlet port 22*b*. A duct 23 depends from the carrier bottom wall 16*a* with its upper end in communication with the inlet port 22*a* of the valve assembly 14 and, when the doll has been put together, said duct 23 is connected to and communicates with the end of the flexible tube 8 which leads from the combined air inlet and one-way valve 6. The outlet port 22*b* communicates with two ducts 24 and 25 which are carried by an initially separate substantially semi-circular dished member 26 (FIG. 3), the duct 25 being of considerably greater effective internal diameter than is the duct 24. Pneumatically-operated sound producing means in the form of a de-tuned reed 27 is fixedly mounted in the duct 25 by an adhesive or in any other convenient known manner. When the doll is assembled, the duct 24 communicates by way of a flexible synthetic plastic tube 28 with a mouthpiece which is generally designated by reference numeral 29 and which will be further described below.

Formed integrally with the cross-bar 18*a* of annular guide 18 are a pair of upstanding lugs 18*b*, between which a lever 30 is turnably mounted by means of a pivot pin 31 which extends perpendicularly between the parallel, spaced lugs 18*b*. One end of the lever 30 is coupled by a flexible but inextensible actuating member in the form of a synthetic plastic cord or lace 32 to the center of the domed abutment plate 12 which closes the upper end of the head bellows 10, said cord 32 extending from the abutment plate 12 to the lever 30 through the interior of the head bellows 10. The other end of the lever 30, remote from the cord 32, normally bears gently against the upper surface of that region of the flexible valve disc 15 whose lower surface sealingly overlies the outlet port 22*b*.

The aforementioned mouthpiece 29 is of substantially cylindrical configuration having an effective axial length or depth that is less than its effective diameter. The mouthpiece 29 includes an inlet tube 33 sealed into a mouth orifice 41 in the head 2 by an adhesive, said inlet tube 33 communicating directly with a first chamber 42 of the mouthpiece 29. Said first chamber 42 is in open communication by way of an angular outlet 34 with one end of a flexible synthetic plastic tube 35 which leads from said outlet through the interior of the head 2 and the interior of the body 1 to a "wetting" orifice 36 at the end of the body 1 that is remote from the head 2. The first chamber 42 of the mouthpiece 29 is sealingly divided from a second chamber 43 thereof by a flexible diaphragm 37 located substantially halfway along the short axial length of the mouthpiece 29. Said second chamber 43 is in open communication with a manifold 44 (FIG. 2), formed in the valve assembly 14 within the semi-circular dished member 26, by way of the flexible tube 28 and the duct 24.

In the assembly of a doll in accordance with the invention, co-operating neck openings 46 and 47 in the head 2 and body 1 are interconnected by a flanged annular coupling member 38 which is formed from a material of considerably greater rigidity than that employed for either the body 1 or the head 2 whereby a child will not readily be able to part the head 2 from the body 1, the construction of said coupling member 38 being, however, such that the head 2 can be turned around the axis 11 relative to the body 1 through, preferably, a little less than 360°, stops that are not shown in the drawings being provided to prevent turning movements in one direction through more than 360°. Both the tubes 8 and 35 interconnect the interior of the head 2 and parts of the body 1 and the flexibility of said tubes is, of course, sufficient to accommodate the turnability of the head 2 through slightly less than 360° but would not be sufficient to accommodate the twisting effect which would be produced by turning said head 2 through considerably more than 360° in one direction with respect to the body 1. The hollow interiors of the body 1 and the head 2 are in open communication with the surrounding atmosphere by way of a hole 39 which is formed in the head 2 in such a position that, when hair (not shown) is provided to cover the head, the hole 39 will be substantially concealed by that hair. If preferred, a number of holes that are considerably smaller than the hole 39 relative to the size of the head 2 may be provided in cases in which a single hole 39 might be visible in an unnatural manner in the finished doll. A neck plate 40 which carries the valve assembly 14 in the head 2 is located immediately above the tubular formation coupling member 38 and is formed with apertures through which pass the ducts 23, 24 and 25 and the tube 35, there still being ample clearance around said ducts and tube to insure that there is unimpeded communication between the open interior of the body 1 and the open interior of the head 2.

In a finished doll in accordance with the invention, a simulated feeding bottle (not shown) containing water is applied to the mouth orifice of the head 2 and the bottle is squeezed to force water from said bottle through the inlet 33 into the first chamber of the mouthpiece 29. As soon as, with the doll generally upright, a lower region of the first chamber 42 of the mouthpiece 29 is filled with water, further water escapes from said first chamber by way of the angular outlet 34 and the flexible tube 35 and issues from the "wetting" orifice 36 so that the doll "wets" the diaper or like garment with which it will usually be provided. The first chamber 42 of the mouthpiece 29 is so shaped that at least a few drops of water will remain therein and will not, even with some random tilting movements of the doll, escape either by way of the tube 35 or the inlet 33 which is, of course, open once the simulated feeding bottle is removed. Little, if any, displacement of the flexible diaphragm 37 takes place during introduction of water into the first chamber 42 of the mouthpiece 29 since it will be remembered that said first chamber remains continually in open communication with the atmosphere by way of the angular outlet 34, the flexible tube 35 and the "wetting" orifice 36.

Figure 5:
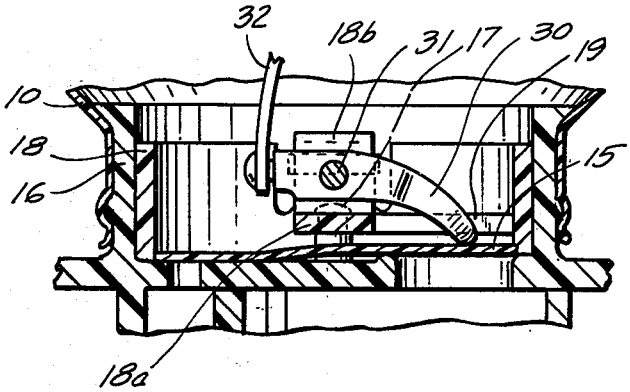
FIG. 5 is a section taken along line 5—5 of FIG. 4, and showing the outlet valve of the head bellows of the doll in closed condition.
Figure 6:
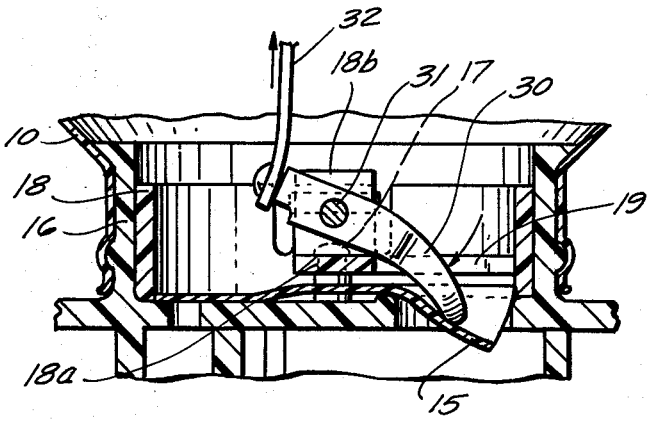
FIG. 6 is a sectional view similar to FIG. 5 but showing the outlet valve in opened condition.

When simulated bottle feeding has been completed and, if desired, simulated diaper changing has also been effected, the next action, to simulate what generally takes place subsequent to feeding of a real baby, is to burp the doll. The doll is held against the shoulder of the child who is playing with it and, in a natural manner, the child pats the small of the back of the doll at approximately the location of the mounting plate 5. Each pat produces some compression of the body bellows 3, the excess air within said bellows passing, via the one-way valve portion of the combined air inlet and one-way valve 6 through the flexible tube 8, to the duct 23 which communicates with the inlet port **22*a* of the valve assembly 14. At the end of each pat, the body bellows 3 rapidly re-assumes its original extended configuration, drawing fresh air into its interior via openings of the air inlet portion of the combined air inlet and one-way valve 6. The air that is forced through the inlet port 22*a* of the valve assembly 14 raises that portion of the flexible valve disc 15 which is to the left of the pins 17, as seen in FIGS. 2 and 3, and thus passes into the interior of the head bellows 10 which expands, against the action of the spring 13, to an extent dependent upon the actual volume of air introduced. After a succession of pats, the head bellows 10 becomes expanded to an extent at which the cord 32 interconnecting the abutment plate 12 and the lever 30 is taut. At the next pat, the introduction of still further air through the inlet port of the valve assembly 14 causes still further expansion of the head bellows 10 to a valve release position shown in phantom FIG. 1, and the cord 32 positively turns the lever 30 about the pivot pin 31 in a clockwise direction as viewed in FIGS. 5 and 6. The free arm of the lever 30 positively pushes that portion of the valve disc 15 that is to the right of the pins 17 as seen in FIGS. 2 and 3 of the drawings downwardly into the outlet port 22*b*, as shown in FIG. 6. The seal between the flexible valve disc and the rim of the outlet port 22*b* is thus broken so that the spring 13 is able to expand and rapidly compress the de-pressurized head bellows 10. The air from the head bellows thus escapes suddenly into the aforementioned manifold 44 that is formed above the semicircular plate 26 from which the major volume of the air passes back into the hollow interior of the body 1 and head 2 via the duct 25, consequently sounding the detuned reed 27 contained within that duct to produce the required burp sound. A lesser quantity of the suddenly released air passes into the tube 28 by way of the duct 24 which, it will be remembered, is of considerably smaller diameter than the duct 25, and thus subjects the second chamber 43 of the mouthpiece 29 to a suddenly increased air pressure. The flexible diaphragm 37 is thus deformed forwardly towards the inlet 33 which causes a reduction in the size of the first chamber 42 of the mouthpiece 29. It will be remembered that some water remains in said first chamber after the simulated feeding operation and the arrangement is such that this deformation of diaphragm 37 causes a few drops of this remaining water to be ejected from the inlet 33 and thus from the mouth orifice A1 of the doll to simulate dribbling. The effect is particularly realistic if the doll is provided with a bib or the like to receive the "dribble". A few drops of water may also reach the "wetting" orifice 36 at the same time but, if, when the doll is in an upright position, the connection of the angular outlet 34 to the first chamber of the mouthpiece 29 is at a slightly higher level than is the connection thereto of the inlet 33, most, if not all, of the ejected water will pass through the inlet 33 to simulate a dribble. As shown in FIGS. 2 and 3, the center of the flexible diaphragm 37 is preferably formed with a projection which is directed towards the inlet 33 so as positively to urge at lease a few drops of water out of said inlet upon a sudden increase in the volume of the second chamber 43 of the mouthpiece 29**.

It will be realized that, with the arrangement that has been described, the pat-to-burp ratio is variable and will depend principally upon the vigor with which the child pats the small of the back of the doll. Somewhere between two very vigorous pats and about six very light pats will usually produce the required burp but this can, of course, vary from doll to doll in accordance with factors such as the efficiency of the one-way valves that are included in any particular production specimen. As mentioned above, the flexible valve disc 15 serves two purposes, one portion thereof serving as the valve member of the inlet port 22*a* to the valve assembly 14 while a second portion thereof serves as the valve member of the outlet port 22*b* of said assembly 14. That portion, which serves as the one-way valve member for the outlet port 22*b*, co-operates, it will be noted, with that outlet port 22*b* in a manner which differs from that of a conventional flap valve. The "pressure" side of the valve coincides with the interior of the head bellows 10 and the outlet side thereof coincides with the hollow interior of the body 1 and head 2 and the valve is opened as a result of the co-operating end of the lever 30 pushing the portion of the disc 15 under consideration positively downwards into the outlet port 22*b* until sealing co-operation is lost with the margin of that outlet port. Once air has escaped from the head bellows 10 to produce the required burp and a dribble, the lever 30 is no longer urged in a clockwise direction by the cord 32, while air pressure inside the head bellows 10 becomes substantially equal to atmospheric pressure and the resiliency of the valve disc 15 causes it to revert to its substantially planar sealing configuration. The detuned reed 27 which produces the required burp sound is located in an upper region of the doll and the sound itself actually escapes to some extent through the hole 39 that is normally covered by the hair of the doll. Generally speaking, a more natural impression of the source of the sound is produced when the alternative arrangement of a number of smaller holes is employed with at least some of those holes located in an upper front region of the head 2 just behind the hairline of the hair (not shown) that is provided in concealing relationship with said holes.

In the embodiment of the doll shown and described herein, the lever 30 positively deflects one portion of the valve disc 15 downwardly into the outlet port 22*b* of the valve assembly 14 by mechanical contact with said valve disc. Thus, in addition to the raised pressure in the head bellows 10 that acts uniformly throughout the surface area of the portion of the valve disc 15 that co-operates with the outlet port 22*b*, the expanded head bellows 10, when the cord 32 is taut, causes the lever 30 to apply an additional force which is concentrated at a single point of contact on the valve disc 15. If the lever 30 were to be omitted, only the raised air pressure within the head bellows 10 would act uniformly against the surface of that portion of the valve disc 15 that co-operates with the outlet port 22*b* and no opening of the outlet port 22*b* would take place until a much higher pressure difference existed between the opposite sides of the valve disc 15 than is necessary with the arrangement that has been described above and that is illustrated in the accompanying drawings.

It is noted that a construction which omitted the lever 30 and the cord 32 or some equivalent means for positively displacing the lever would detract from the advantageously cooperating features of the doll in three ways. Firstly, such a construction would essentially involve quite vigorous patting of the doll and, usually, a larger number of pats before any burp resulted. Secondly, when the air pressure in the head bellows eventually reached a level sufficient to allow it, alone, to deflect and open an unaided flap valve substantially equivalent to the valve disc 15 with the omission of the lever 30, the air accumulated in the head bellows would escape with such a force, and at such a velocity, that it would have a disadvantageous aerodynamic effect upon the de-tuned reed 27 or an equivalent pneumatically operated sound producing means. The de-tuned reed 27 or equivalent sound producing means would, instead of being excited into sounding vibration, tend to be jammed by the escaping air into a closed position. This would result in substantially no sound at all, a strangled squeak or a loud hissing noise and none of these, it will be realized, would be satisfactory having regard to the purpose for which the doll is intended. Thirdly, as soon as the air rapidly escaping from the head bellows allowed the pressure in that bellows to fall below a value sufficient to hold the valve disc or other flap valve open, said flap valve would close and trap the remainder of the compressed air within the still partly expanded head bellows. This is because, with such a construction, the air pressure necessary to keep the flap valve open is only a little less than that required to open it in the first place and thus only a small proportion of the air trapped within the head bellows would be able to escape before the flap valve became closed and stopped such escape.

With the arrangement that has been described in connection with the accompanying drawings, that portion of the valve disc 15 which co-operates with the outlet port 22*b* is opened as a result of the displacement thereof that is caused by the movement of the lever 30 which contacts said valve disc at a single point, the air from the head bellows 10 thus being able to escape through the outlet port 22*b* at a considerably lower pressure than would be possible if reliance were placed upon the raised pressure of the air within the head bellows 10 alone. Since the air from the head bellows 10 can escape through the outlet port 22*b* at a relatively low pressure, and thus at a relatively slow velocity, the de-tuned reed 27 or other pneumatically operated sound producing means operates at substantially optimum efficiency to produce a clearly audible burp-like noise. Lastly, because the valve disc 15 is positively held open by the lever during the initial stage of an air release from the head bellows 10, and because said release takes place at a relatively low pressure, the time during which the outlet port 22*b* remains open before the valve disc 15 resumes its substantially planar closing configuration is significantly greater than would be the case if a more conventional flap valve were to be used as discussed above. In fact, practical experience has shown that the valve disc 15 does not resume a sealing relationship with the outlet port 22 until the head bellows 10 has been completely, or substantially completely, emptied by the compressing effect of the spring 13.

It will be appreciated from the foregoing description that the use of the lever 30, in combination with the valve assembly 14, has the considerable advantages, as compared with a valve arrangement omitting the lever 30 and employing a substantially conventional flap valve, of reducing the patting effort that is necessary by a child to cause the doll to burp, usefully employing a much greater proportion of the air pumped into the head bellows by each patting sequence to produce a brup, and by supplying the air released from the head bellows to the de-tuned reed 27 or other pneumatically operated sound producing means in such a way as to result in a clearly audible and natural sounding burp of adequate, rather than abbreviated, duration.

While a preferred embodiment of the invention has been shown and described herein, it is obvious that numerous additions, changes and omissions may be made in such embodiment without departing from the spirit and scope of the invention.

What is claimed is:

1. A doll comprising a hollow head and a hollow body communicating with said head and having a flexible wall, a body bellows mounted within said body and operatively associated with said flexible wall for compression when said flexible wall is depressed inwardly, said body bellows having an air outlet opening, a head bellows mounted within the interior of said hollow head and having an inlet port, and outlet port, an outlet valve normally closing said outlet port, and biasing means urging said head bellows to a compressed position, pneumatically-operated sound producing means mounted within said head and communicating with the outlet port of said head bellows through said outlet valve, conduit means connecting the air outlet opening of said body bellows to the inlet port of said head bellows for supplying a charge of air to the interior of said head bellows with each compression of said body bellows, said head bellows being adapted to expand in successive increments from said compressed position to an expanded release position upon successive compressions of said body bellows, and valve release means mounted within said head bellows and operatively connected to a movable portion of said head bellows and to said outlet valve for opening said outlet valve in response to expansion of said head bellows to said release position, whereby upon opening of said outlet valve, said biasing means moves said head bellows to said compressed position, causing air in said head bellows to escape through said outlet port in a sudden flow through said sound producing means.

2. A doll according to claim 1 in which said outlet valve comprises a flexible valve disc sealingly overlying said outlet port of said head bellows and in which said valve release means comprises a lever pivotally mounted within said head bellows and having a first arm connected to a movable portion of said head bellows and a second arm engaging the portion of the valve disc which overlies the outlet port.

3. A doll according to claim 2 in which said head bellows has an end wall immovably mounted in said head and a movable end wall, said first arm of said lever being connected to said movable end wall.

4. A doll according to claim 2 in which said flexible valve disc overlies both said inlet port and outlet port and serves as both an air inlet valve and an air outlet valve for said head bellows.

5. A doll according to claim 4 in which the second arm of said lever depresses into said outlet port the portion of the valve disc which overlies said outlet port when said lever is actuated in response to said head bellows reaching said expanded release position.

6. A doll according to claim 2 in which said hollow head has a mouth orifice and a hollow mouthpiece communicating with said mouth orifice, said mouthpiece comprising a closed housing and a flexible diaphragm dividing the interior of said housing into a first chamber and an adjacent second chamber, said first chamber communicating with said mouth orifice, conduit means connecting said second chamber in communication with the outlet port of said head bellows, whereby when said head bellows is moved to said compressed position, air is fed from said head bellows into said second chamber, causing said flexible diaphragm to reduce the size of said first chamber.

7. A doll according to claim 6 in which said mouth orifice is sized to receive the outlet of a feeding bottle for supplying water to the first chamber of said mouthpiece, said doll also including a liquid discharge orifice at the lower end of said hollow body, and conduit means connecting said first chamber with said liquid discharge orifice.

8. A doll according to claim 6 in which said outlet port of said head bellows communicates with a manifold having a first air outlet opening communicating with said sound producing means, and a second outlet opening communicating with the second chamber of said mouthpiece through said conduit means.

9. A doll according to claim 8 in which said second outlet opening is of smaller size than said first outlet opening.

10. A doll according to claim 5 in which said head bellows has an open end and in which a cylindrical carrier closes off said open end of the head bellows, said cylindrical carrier having a bottom wall containing said inlet port at one side thereof and said outlet port on the other side thereof, said flexible valve disc overlying said bottom wall and the inlet and outlet ports therein, with a marginal edge portion of said valve disc positioned to be depressed into said outlet port by the second arm of said lever.

* * * * *